US005836720A

United States Patent [19]

Stankus et al.

[11] Patent Number: 5,836,720

[45] Date of Patent: Nov. 17, 1998

[54] MINE ROOF SUPPORT SYSTEM

[75] Inventors: John C. Stankus, Canonsburg; John G. Oldsen, Butler, both of Pa.; Brian R. Castle, Rolla, Mo.

[73] Assignee: Jennmar Corporation, Pittsburgh, Pa.

[21] Appl. No.: 659,040

[22] Filed: Jun. 3, 1996

[51] Int. Cl.[6] ..... E21D 21/00

[52] U.S. Cl. ..... 405/302.2; 405/259.6; 405/288

[58] Field of Search ..... 405/302.1, 288, 405/302.2, 302.3, 259.1

[56] References Cited

U.S. PATENT DOCUMENTS

| | | | |
|---|---|---|---|
| 3,077,809 | 2/1963 | Harding et al. . | |
| 3,509,726 | 5/1970 | White | 405/302.2 |
| 3,601,994 | 8/1971 | Gallis . | |
| 4,247,225 | 1/1981 | Chickini, Jr. et al. . | |
| 4,265,571 | 5/1981 | Scott | 405/259 |
| 4,360,292 | 11/1982 | Keeler et al. | 405/244 |
| 4,456,405 | 6/1984 | Galis | 405/288 |
| 4,498,816 | 2/1985 | Korpela et al. | 405/259 |
| 4,601,616 | 7/1986 | Barish et al. | 405/288 |
| 4,630,974 | 12/1986 | Sherman | 405/288 |
| 4,666,344 | 5/1987 | Seegmiller | 405/259 |
| 4,679,967 | 7/1987 | Hipkins, Sr. et al. | 405/288 |
| 4,699,547 | 10/1987 | Seegmiller | 405/288 |
| 4,749,310 | 6/1988 | White | 405/288 |
| 4,767,242 | 8/1988 | McLaren | 405/288 |
| 4,776,729 | 10/1988 | Seegmiller | 405/288 |
| 4,784,531 | 11/1988 | Calandra, Jr. | 405/261 |
| 4,798,501 | 1/1989 | Spies | 405/260 |
| 4,934,873 | 6/1990 | Calandra, Jr. | 405/288 |
| 4,946,315 | 8/1990 | Chugh et al. | 405/288 |
| 5,018,907 | 5/1991 | Chugh et al. | 405/288 |
| 5,026,217 | 6/1991 | Seegmiller | 405/288 |
| 5,042,961 | 8/1991 | Scott et al. . | |
| 5,052,861 | 10/1991 | Hipkins, Sr. . | |
| 5,181,800 | 1/1993 | Stankus et al. | 405/259.6 |
| 5,193,940 | 3/1993 | Long | 405/259.1 |
| 5,230,589 | 7/1993 | Gillespie | 405/259.6 |
| 5,238,329 | 8/1993 | Long et al. | 405/288 |
| 5,259,703 | 11/1993 | Gillespie | 405/259.6 |
| 5,288,176 | 2/1994 | Huff et al. | 405/259.6 |
| 5,375,946 | 12/1994 | Locotos | 405/259.4 |
| 5,378,087 | 1/1995 | Locotos | 405/259.5 |
| 5,415,498 | 5/1995 | Seegmiller | 405/288 |
| 5,425,602 | 6/1995 | Seegmiller | 405/288 X |
| 5,458,442 | 10/1995 | Ashmore | 105/302.2 |
| 5,462,391 | 10/1995 | Castle et al. | 405/302.2 |
| 5,466,095 | 11/1995 | Scott | 405/302.2 |
| 5,584,608 | 12/1996 | Gillespie | 405/259.6 |
| 5,624,212 | 4/1997 | Gillespie | 405/302.2 |

FOREIGN PATENT DOCUMENTS

| | | |
|---|---|---|
| 7265987 | 10/1988 | Australia . |
| 3906585 | 9/1989 | Australia . |
| 4899293 | 2/1996 | Australia . |
| WO8400048 | 1/1984 | European Pat. Off. . |
| WO9303256 | 2/1993 | European Pat. Off. . |
| 1608289 | 7/1973 | Germany . |

OTHER PUBLICATIONS

DYWIDAG Systems International, USA, Inc., "DYWIDAG Tensionable Cable Bolt," advertisement, *E&MJ,* Feb. 1994, pp. WW–45.

*Primary Examiner*—Dennis L. Taylor
*Attorney, Agent, or Firm*—Webb Ziesenheim Bruening Logsdon Orkin & Hanson, P.C.

[57] ABSTRACT

The present invention relates to a cable truss system for supporting a mine roof. The system includes at least one cable bolt secured in at least a pair of spaced boreholes. A leading end of each cable bolt is secured within the borehole and the trailing end extending out of the borehole. At least one splice tube is coupled to the trailing end of each cable bolt. Each splice tube includes an elongated conduit between a pair of spaced ends with the conduit adapted to receive at least a pair of cables therethrough. Cable attachments are provided on the trailing end of each cable bolt at a position on the cable bolt such that the splice tube is positioned between the cable attachment and the borehole. The cable attachment has a diameter larger than the inner dimensions of the conduit of the splice tube such that the cable attachment is adapted to abut against one end of the conduit of the splice tube.

3 Claims, 11 Drawing Sheets

MINE ROOF SUPPORT SYSTEM

BACKGROUND OF THE INVENTION

1. Field of the Invention

The present invention relates to an underground mine roof supporting system and, more particularly, to a cable truss system.

2. Prior Art

Roof trusses, or roof support systems for mines, are well-known methods for providing support to the immediate roof strata. U.S. Pat. Nos. 4,946,315 and 5,018,907 disclose typical roof truss systems utilizing interconnected tie rods extending between rigid roof bolts. U.S. Pat. No. 5,415,498 discloses a mine roof support system utilizing a flexible cable in place of tie rods, extending between rigid rock anchors or bolts.

Cable mine roof bolts have become popular due to several advantages over a more rigid rebar-type rock anchor. Cable bolts generally require a smaller diameter borehole, are easier to transport into the mine and easier to insert in applications with low seam height due to the bending of the cable. Additionally, cable bolts do not require couplings for long boreholes as rebar type rock anchors.

A variety of cable truss systems have been developed such as disclosed in U.S. Pat. Nos. 4,265,571; 5,462,391 and 5,466,095. U.S. Pat. No. 5,378,087 discloses a variety of mine roof support systems including systems utilizing cable mine roof bolts and more rigid rebar-type mine roof bolts. However, the difficulty with the above-described prior art cable mine roof trusses that they do not provide cost-effective cable truss systems for a variety of applications. Much of the prior art requires highly specialized pieces, making the resulting truss system overly complicated, impractical and noneconomical to manufacture.

SUMMARY OF THE INVENTION

The object of the present invention is to overcome the aforementioned drawbacks of the prior art. A further object of the present invention is to provide a cable truss system which is economical to manufacture and easy to use to promote industry acceptance.

The objects of the present invention are achieved by providing a cable mine roof supporting system according to the present invention. The cable truss of the present invention includes at least two boreholes spaced from each other with at least one cable roof bolt secured in each borehole. A leading end of each cable bolt is secured within one borehole with a trailing end thereof extending from the borehole. At least one splice tube is coupled to the trailing end of each cable bolt with each splice tube comprising an elongated conduit between a pair of spaced ends. The splice tube conduit is adapted to receive at least a pair of cables therethrough. A cable attachment is provided on a trailing end of each cable roof bolt at a position where the splice tube is between the cable attachment and the borehole. The cable attachment has a diameter larger than the inner dimensions of the splice tube conduit such that the cable attachment is adapted to abut against one end of the splice tube conduit.

In one embodiment of the present invention, each splice tube connects two cable bolts extending from two of the spaced boreholes together.

In a further embodiment of the present invention, at least one roof support cable extends between two of the spaced boreholes with the support cable attached to one of the cable roof bolts by one of the splice tubes at a first end of the support cable and attached to another of the cable bolts by another of the splice tubes at the second end of the support cable.

The present invention additionally includes a roof support plate held against the mine roof by the cable roof supporting system of the present invention. A plurality of such plates may be held against the mine roof by the cable roof supporting system between the spaced boreholes. Each roof plate of the present invention includes a load-bearing surface positioned adjacent the mine roof and a raised support member extending from the load-bearing surface. A cable engaging member extends from the support member and is adapted to secure the roof plate to a cable. In one embodiment of the present invention, the cable engaging member is formed of at least one clamping finger adapted to clamp a cable between the finger and the raised support member to secure the roof plate thereto.

In the present invention, the cable attachments may be formed of a conventional barrel and wedge assembly. Additionally, the present invention may provide a drivehead on each cable bolt for rotating the cable bolt during installation of the cable bolt in the borehole. The drivehead may be formed separate from the barrel and wedge assembly. The present invention may further include a resin dam on each cable bolt in the borehole preventing the resin from moving past the dam and the borehole during installation. The resin dam will additionally provide for compression of the resin within the borehole.

The present invention may further include at least one cable bolt plate positioned adjacent one of the boreholes and engaging one of the cable bolts. The cable bolt plate preferably includes an arcuate section extending from the borehole with the engaging cable bolt following the arcuate section such that the cable bolts extend substantially horizontally from the cable bolt plate. The cable bolt plate may further include a mechanism for coupling a splice tube thereto. This configuration creates an active system in which the cable bolts of the cable truss system may be first installed and tensioned in a relatively quick fashion. Following the installation of the cable bolts, the remaining portions of the cable truss system of the present invention can be installed later, if required. This two-step installation process provides a number of advantages.

These and further objects of the present invention will be clarified in the description of the preferred embodiments taken together with the attached figures wherein like reference numerals represent like characters throughout.

BRIEF DESCRIPTION OF THE PREFERRED EMBODIMENTS

Figure 1:
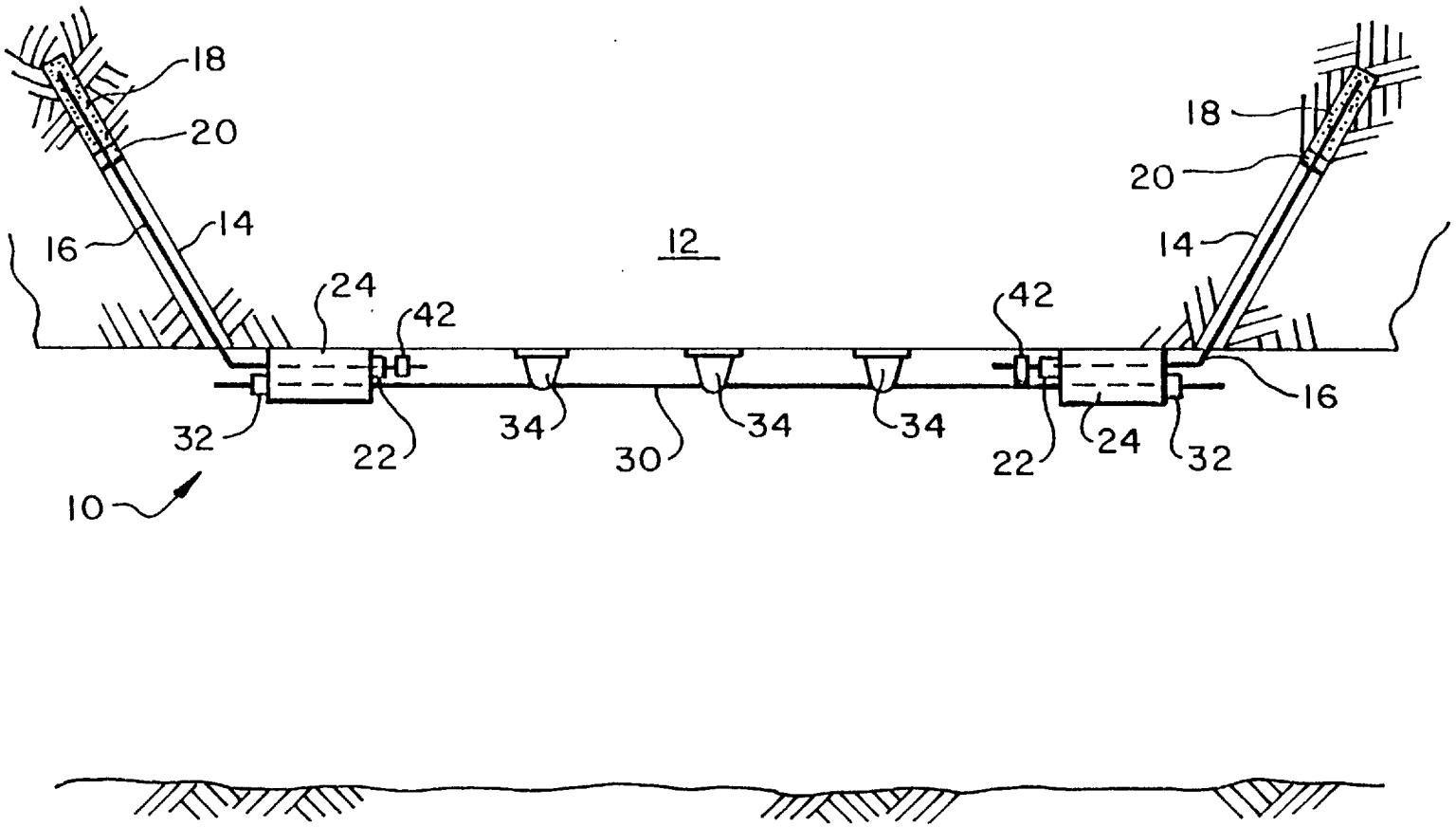
FIG. 1 schematically illustrates a cable truss system according to a first embodiment of the present invention.

FIG. 1 schematically illustrates a cable truss system 10 for supporting the roof strata 12 of a mine. The cable truss system 10 includes a pair of spaced-apart boreholes 14 drilled into the roof strata 12 in a conventional fashion.

The boreholes 14 may extend substantially vertically into the roof strata or at an angle thereto, as shown in FIG. 1, as is well-known in the art. A cable bolt 16 is secured within each borehole 14 by a cured resin mixture 18.

Each cable bolt 16 is preferably formed of a multi-strand cable having a center or king strand and six peripheral helically wound strands surrounding the king strand. Appropriate cable is described in ASTM Designations A 416 for steel cable and A 586 for galvanized steel cable, both of which are used for forming cable bolts or cable rock anchors in the mining industry.

In installation, the resin 18 is normally forced in the borehole 14 before the cable bolt 16. The cable bolt 16 is advanced and rotated, rupturing the resin packages and mixing the resin during the installation procedure. The advancing and rotation of the cable bolt 16 is accomplished by appropriate bolting equipment. Following the mixing of the resin 18, the resin 18 is allowed to cure to secure the leading end of the cable bolt 16 within the borehole 14. A resin dam 20 may be provided on the leading end of the cable bolt 16 to prevent the resin 18 from extending down the borehole 14 past the resin dam 20. The resin dam 20 will compress and maintain the resin 18 in the desired location within the borehole 14. The resin dam 20 may be constructed according to the description in U.S. Pat. No. 5,181,800, although other resin dam configurations may also be utilized.

A trailing end of the cable bolt 16 extends from the borehole 14. A load-bearing cable attachment member 22 is attached to the trailing end of each cable bolt 16. The attachment member 22 may be effectively formed as a conventional barrel and wedge assembly. A conventional barrel and wedge assembly is a standard load-bearing cable attachment including a substantially cylindrical barrel having a tapered opening therein for receiving a cable therethrough with a plurality of locking wedges surrounding the cable within the tapered opening of the barrel for securing the barrel to the cable. After the barrel and wedge assembly is secured to the cable, the front face of the barrel and wedge assembly will provide a load-bearing surface for loading of the associated cable bolt 16.

Figure 2:
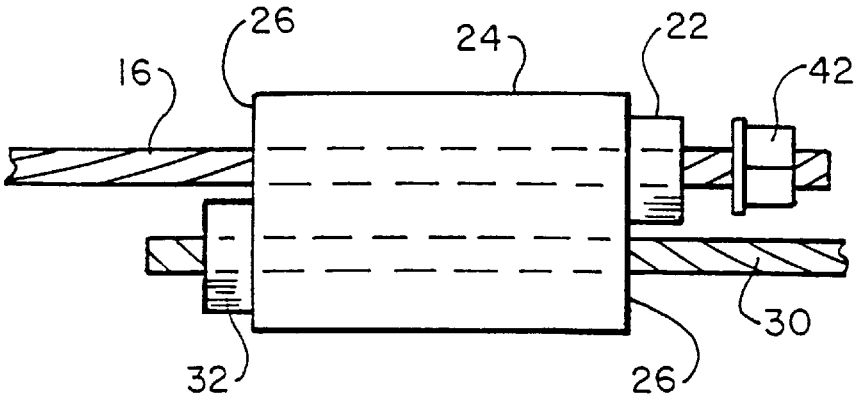
FIG. 2 is a side view of a splice tube used in the cable truss system illustrated in FIG. 1.
Figure 3A:
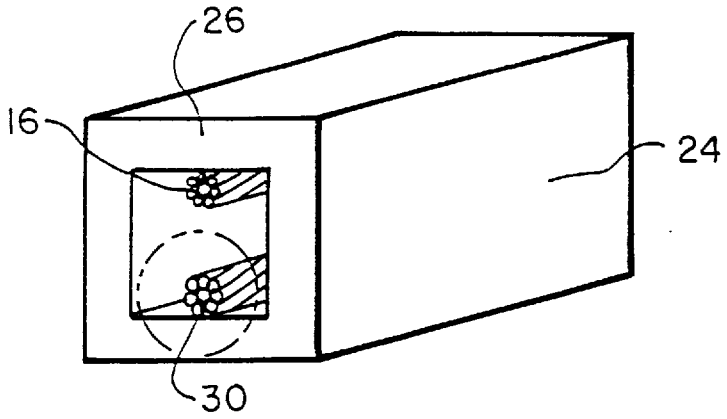
FIG. 3A is a perspective view of the splice tube illustrated in FIG. 2.

A splice tube 24 is positioned on the trailing end of the cable bolt 16 between the borehole 14 and the attachment member 22. The splice tube 24 is best illustrated in FIGS. 2 and 3A and is formed of an elongated conduit between a pair of spaced ends 26. The splice tube conduit receives a pair of cables therethrough as illustrated in FIG. 2. The attachment member 22 has a diameter larger than the inner dimensions of the conduit of the splice tube 24 such that the attachment member 22 abuts against one end 26 of the splice tube 24.

Figure 3B:
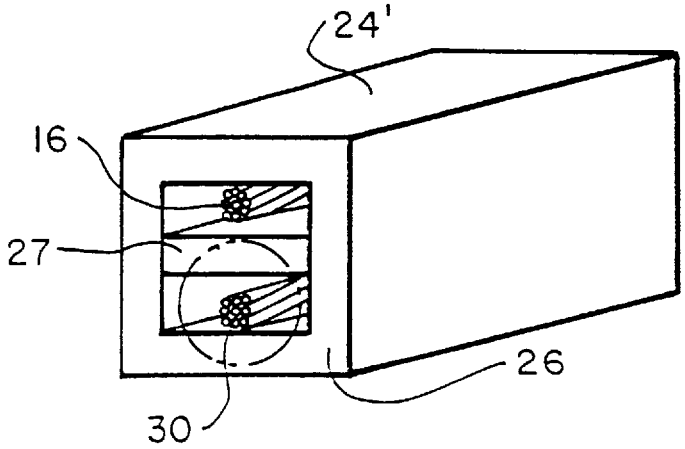
FIG. 3B is a perspective view of a modified version of the splice tube illustrated in FIG. 3A.

Effective splice tubes 24, according to the present invention, have been formed out of a generally rectangular configuration having dimensions of the conduit of the splice tube 24 of an opening of 2½" by 1½" with the thickness of the splice tube 24 being approximately ¼" thick with the splice tube formed of steel. The length of a splice tube 24 is preferably long enough such that the compressive forces acting on the splice tube 24 will act along a substantial length of the splice tube 24. A length of greater than 7" has been found to be preferable with a length of about 8" forming a very effective splice tube 24 according to the present invention. FIG. 3B shows a modified splice tube 24' which includes a center web 27 extending between the sides of the splice tube 24'. The modified splice tube 24' differs from the splice tube 24 only by the provision of the center web 27. The center web 27 divides the interior conduit of the splice tube 24' into two separate channels each adapted to receive one cable therethrough. Additionally, the center web 27 provides structural support to the splice tube 24' and provides another bearing surface for the attachment member 22.

The cable truss system 10 shown in FIG. 1 additionally includes a roof support cable 30 extending between the spaced boreholes 14. The support cable 30 is attached to each cable bolt 16 by one splice tube 24 at respective ends of the support cable 30. The roof support cable 30 is formed of a multi-strand cable substantially the same as the cable forming the cable bolt 16 described above. A support cable attachment member 32 is attached to each respective end of the support cable 30. The support cable attachment member 32 may be formed of a conventional barrel and wedge assembly substantially the same as the attachment members 22 described above. Each support cable attachment member 32 has a diameter (shown in phantom in FIGS. 3A and 3B) larger than the inner dimensions of the conduit of the splice tube 24 and is adapted to abut against an opposite end 26 of the splice tube 24 from the attachment member 22 of the attached cable bolt 16 as shown in FIG. 2.

Figure 4:
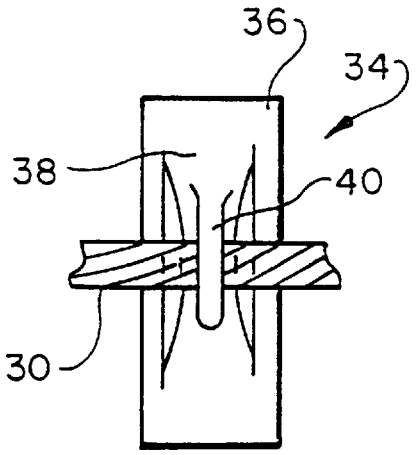
FIG. 4 is a plan view of a roof support plate used in the cable truss system illustrated in FIG. 1.
Figure 5:
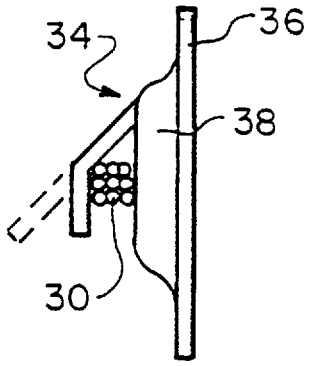
FIG. 5 is a side view of the roof support plate illustrated in FIG. 4.

A plurality of roof support plates 34 are held against the roof strata 12 by the cable truss system 10 between the spaced boreholes 14. The individual support plates 34 are shown in better detail in FIGS. 4 and 5. Each roof support plate 34 includes a generally planar load-bearing surface 36 positioned adjacent the roof strata 12. A raised support member 38 extends up from the load-bearing surface 36. A clamping finger 40 extends from the raised support member 38 and is adapted to clamp a cable, such as cable bolt 16 or the cable of roof support cable 30, between the clamping finger 40 and the raised support member 38 to secure the roof support plate 34 to the cable. The roof support plates 34 are configured for easy manufacture by being stamped out of appropriate steel plates on a hydraulic press.

Figure 6:
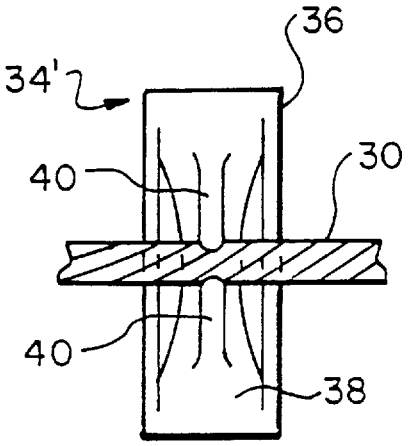
FIG. 6 is a plan view of a modified roof support plate utilized in the cable truss system illustrated in FIG. 1.
Figure 7:
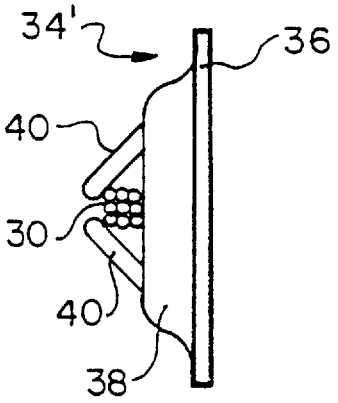
FIG. 7 is a side view of the roof support plate illustrated in FIG. 6.

FIGS. 6 and 7 illustrate a modified roof support plate 34' according to the present invention. The modified roof support plate 34' includes a load-bearing surface 36 and raised support member 38 substantially the same as roof support plates 34 described above. The modified roof support plate 34' includes a pair of clamping fingers 40 extending from the raised support member 38 as shown in FIGS. 6 and 7. The clamping fingers 40 of the modified roof support plate 34' are adapted to clamp a cable between the clamping fingers 40 and the raised support member 38 substantially the same as in the roof support plate 34.

The installation of the cable truss system 10 according to the present invention operates as follows. The boreholes 14 are appropriately positioned and drilled in the roof strata 12 in a conventional fashion. The resin 18 in cartridge form is pushed into the boreholes 14 by the cable bolt 16. The cable bolt 16 may include bird cages and/or buttons swaged onto the cable or the like at the leading end thereof to enhance the mixing and bonding with the resin. The cable bolt is advanced and rotated by appropriate bolting equipment, such as the wrench described in U.S. patent application Ser. No. 08/360,261 which is incorporated herein by reference. The advancing of the cable bolt 16 will break the resin cartridges, move the lead end of the cable bolt 16 to the back/top of the borehole 14 and the rotation of the cable bolt 16 will mix the resin for the appropriate time. Following the mixing of the resin 18, the rotation of the cable bolt 16 is ceased and the resin allowed to cure to secure the cable bolt 16 within the borehole 14. The resin dam 20 will prevent the resin 18 from moving past the resin dam 20 along the borehole 14. When using bolting equipment such as described in U.S. patent application Ser. No. 08/360,261, the splice tube 24 and attachment member 22 will be attached to each cable bolt 16 after the resin 18 has cured.

Following the attachment of the splice tube 24 and the attachment member 22 to the cable bolt 16, the roof support cable 30 can be attached to each cable bolt 16 by the appropriate splice tubes 24. The support cable attachment members 32 are secured in the respective ends of the roof support cable 30 after the roof support cable 30 is positioned through the appropriate splice tubes 24. The plurality of roof support plates 34 and/or 34' are attached along the roof support cable 30 and the cable of the cable bolt 16, as shown in FIG. 1, and secured in position by clamping the respective clamping fingers 40 against the respective cable to clamp the cable between the clamping finger 40 and the raised support member 38. The original position of the clamping fingers 40 prior to installation is shown in phantom in FIG. 5. During installation, the clamping fingers 40 are bent around the cable to secure the roof support plates 34 and/or 34' thereto. The clamping fingers 40 will hold the roof support plate 34 or 34' in position until the cable truss system 10 can be appropriately tensioned. Following the position of the roof support plates 34 and/or 34', the cable truss system 10 can be appropriately tensioned by a hydraulic tensioning unit pulling on one end of the roof support cable 30 extending past the respective support cable attachment member 32. The tensioning of the cable truss system 10 will secure the roof support plates 34 against the roof.

An alternative installation procedure is to provide each cable bolt 16 with a means for driving the cable bolt 16 such as rotatable bolt head 42. The bolt head 42 may be the type as described in co-pending U.S. patent application Ser. No. 08/585,319 which is incorporated herein by reference. If the bolt head 42 is provided on the cable bolt 16, the attachment member 22 and splice tube 24 will be positioned on the cable bolt 16 prior to the mixing and setting of the resin 18. When using the bolt head 42, each cable bolt 16 may further include a conventional stiffener tube extending along the length within the splice tube 24 to assist in the installation procedure. The separate bolt head 42 allows more conventional bolting equipment to be utilized for the installation of each cable bolt 16. An alternative embodiment for forming the separate driving mechanisms for rotation of the cable bolt 16 during installation would be to form driving faces on the attachment members 22 similar to that described in U.S. Pat. Nos. 5,203,589 and 5,259,703. Following the installation of the preassembled cable bolt 16, attachment member 22 and splice tube 24, the remaining portions of the cable truss system 10 will be added in the same manner described above.

Figure 8:
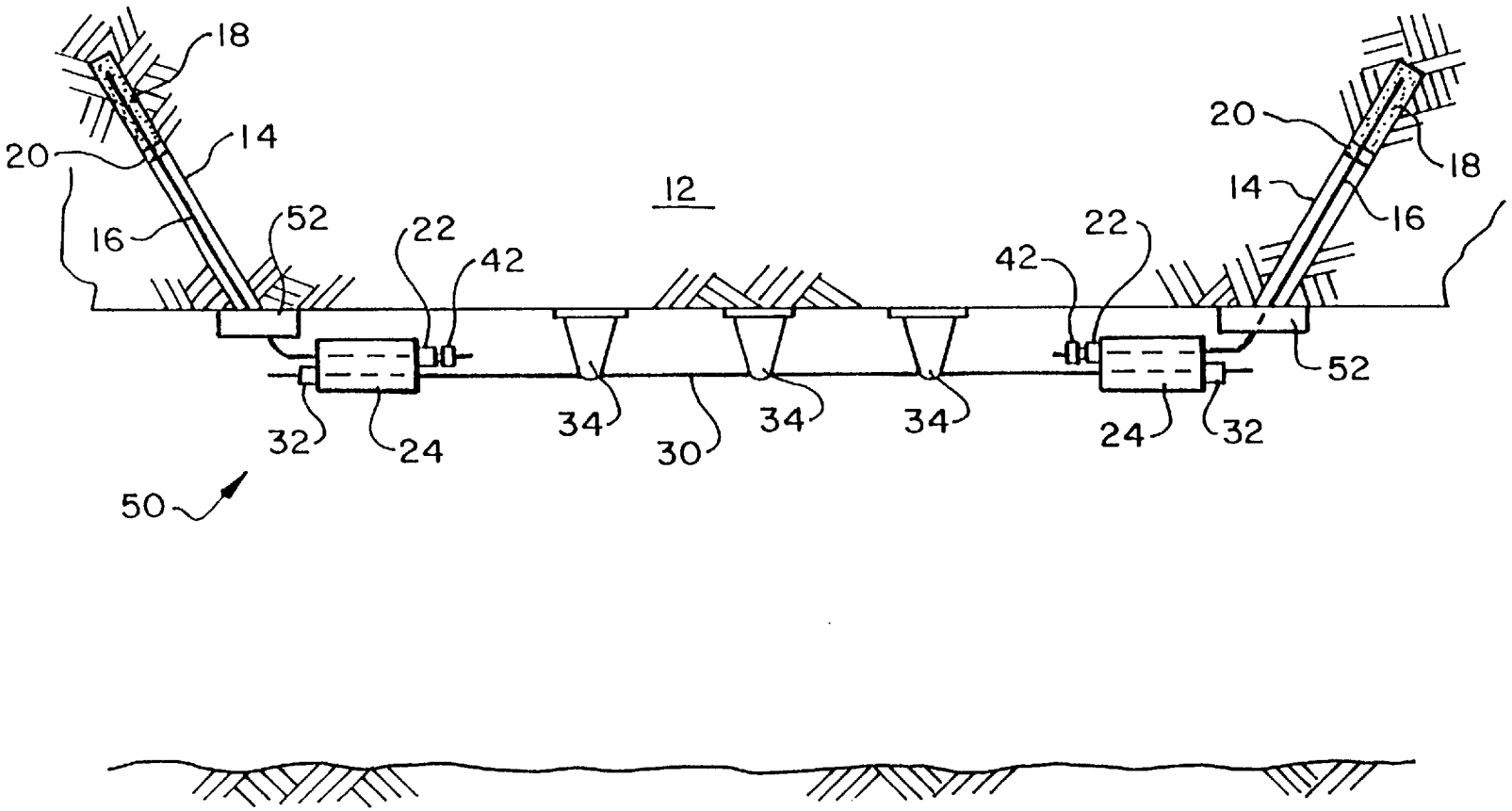
FIG. 8 schematically illustrates a modified version of the cable truss system illustrated in FIG. 1.

FIG. 8 schematically illustrates a cable truss system 50 according to the present invention which is substantially similar to the cable truss system 10 described above in connection with FIGS. 1–7. Specifically, the cable truss system 50 includes spaced boreholes 14 formed in the roof strata 12 with a pair of cable bolts 16 secured by resin 18 therein. The cable bolts 16 include resin dam 20 and attachment members 22. The attachment member 22 abuts against one end 26 of a splice tube 24 to secure each cable bolt 16 to a roof support cable 30 extending between the boreholes 14. Support cable attachment members 32 abut against the opposite ends 26 of each splice tube 24. The cable truss system 50 further includes roof support plates 34 with load-bearing surfaces 36, raised support members 38 and clamping fingers 40. The cable truss system 50 may further include the use of bolt heads 42 in the same manner described above in connection with cable truss system 10 if conventional bolting equipment is desired to install the cable bolt 16.

Figure 9:
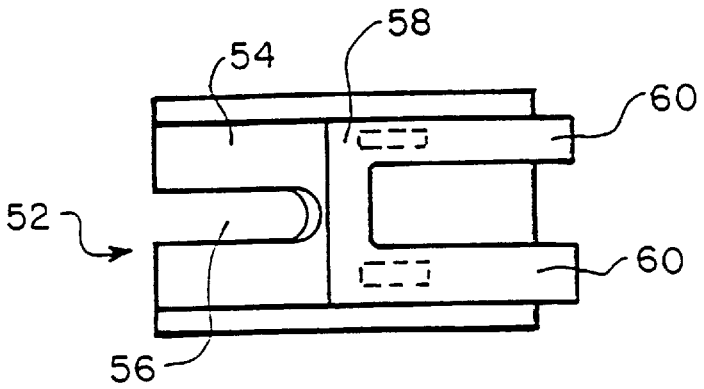
FIG. 9 is a plan view of a cable bolt plate utilized with the cable truss system illustrated in FIG. 8.
Figure 10:
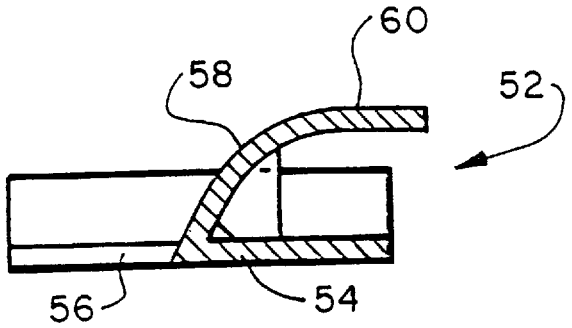
FIG. 10 is a side view of the cable bolt plate illustrated in FIG. 9.
Figure 11:
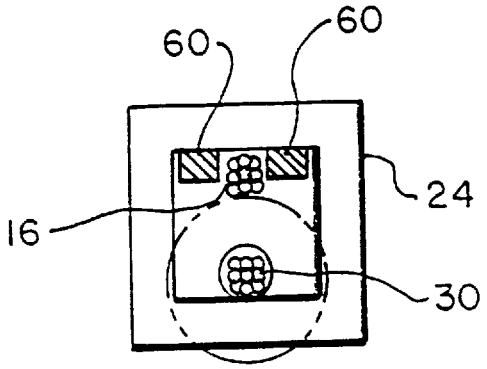
FIG. 11 is a cross-sectional end view of a splice tube utilized in the cable truss system illustrated in FIG. 8.
Figure 12:
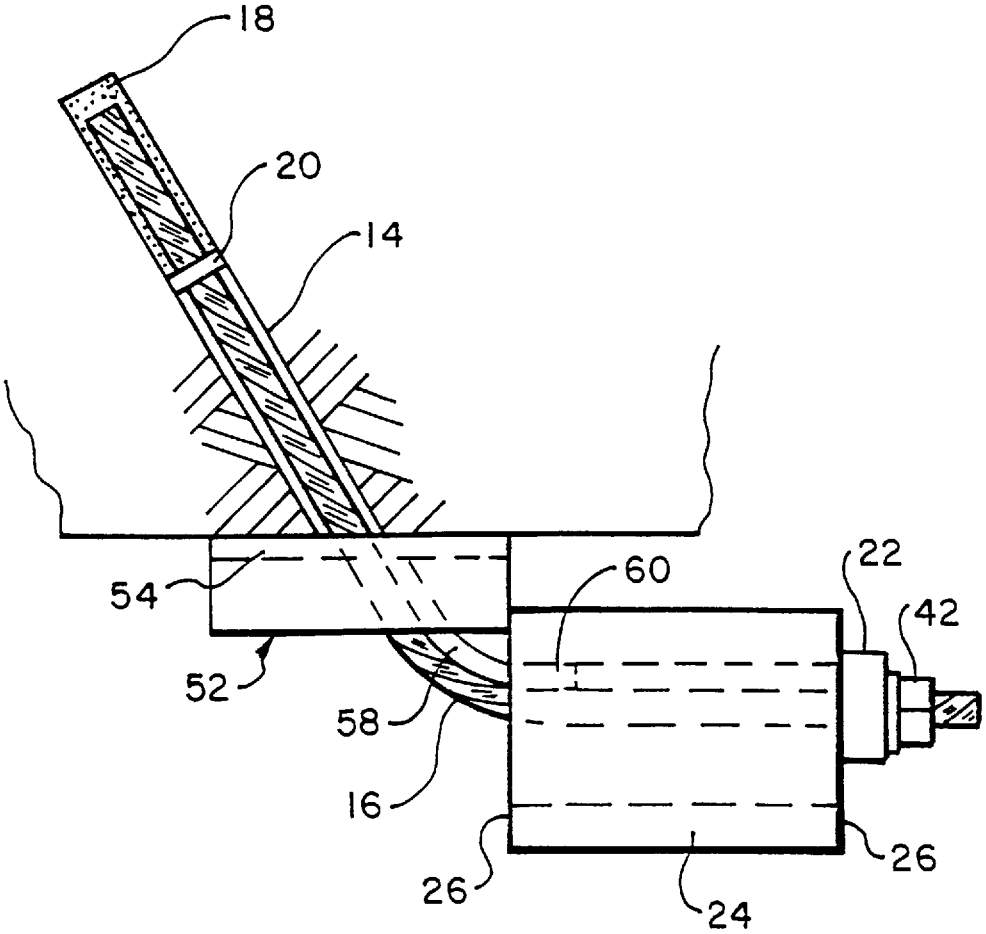
FIG. 12 schematically illustrates an installed cable bolt for use in the cable truss system illustrated in FIG. 8.

The cable truss system 50 differs from the cable truss system 10 by the inclusion of a cable bolt plate 52 positioned adjacent each borehole 14 and engaging one cable bolt 16. Each cable bolt plate 52, shown in detail in FIGS. 9 and 10, includes a base 54 with a cable opening 56 therein which aligns with the borehole 14 for receiving the cable therethrough of the cable bolt 16. An arcuate guide 58 extends from the base 54 to a position extending substantially parallel with the base 54. As shown in FIGS. 8 and 12, the cable of the cable bolt 16 follows the arcuate guide 58 extending substantially horizontally at a position following the arcuate guide 58. The arcuate guide 58 is provided to maintain a gradual bend in the cable bolt 16 to minimize stress concentration due to a change in orientation of the cable extending from the boreholes 14. Additionally, each cable bolt plate 52 includes locking prongs 60 which engage the splice tube 24 to secure the splice tube 24 thereto. Engagement of the locking prongs 60 with the splice tube 24 can be seen in FIG. 11.

In addition to reducing the stress concentration of the cable bolt 16, the cable bolt plates 52 allow the cable truss system 50 to become an active system. Specifically, with the cable bolt plates 52, the individual cable bolts 16 can be installed and tensioned independent of a subsequent inclusion of a roof support cable 30. Each cable bolt 16 can be installed in the borehole 14 substantially the same as described in connection with cable truss system 10. This installation includes the use of bolt head 42 or a modified attachment member 22 as described in U.S. Pat. No. 5,203,589 or the use of the wrench described in U.S. patent application Ser. No. 08/360,261. Once the resin 18 has cured, the cable bolt plate 52 can be positioned and a hydraulic tensioning unit used to tension the cable bolt 16. The locking prongs 60 will secure the splice tube 24 thereto and maintain the splice tube 24 in a substantially horizontal configuration. Following the tensioning of the individual cable bolts 16, the installed, tensioned cable bolts 16 will appear as shown in FIG. 12 and are independent of the subsequent installation of a roof support cable 30 and corresponding roof support plates 34 which may be attached later, if needed. This separability of the installation of the cable bolts 16 and the roof support cables 30 allows the cable bolts 16 to be installed first and then, only if necessary, roof support cables 30 can be subsequently installed, as needed.

Figure 13:
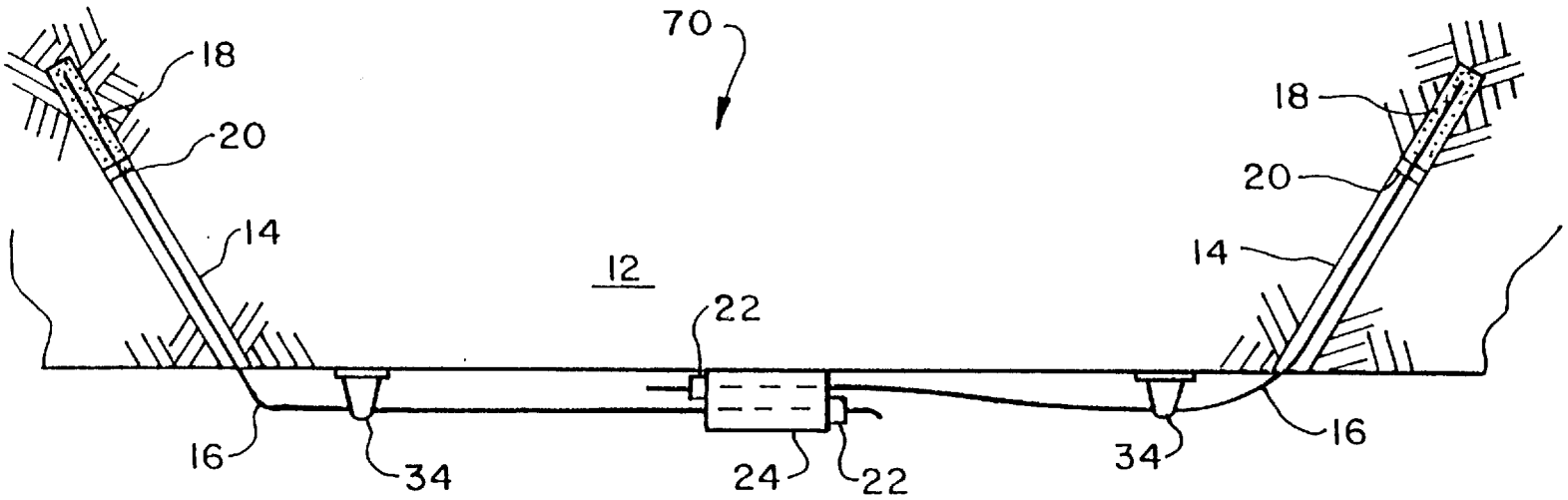
FIG. 13 schematically illustrates a cable truss system according to a second embodiment of the present invention.

FIG. 13 illustrates a cable truss system 70 according to a second embodiment of the present invention. The cable truss system 70 includes substantially the same elements of the cable truss systems 10 and 50 described above, except without a separate roof support cable 30. Specifically, the cable truss system 70 includes spaced boreholes 14 in the roof strata 12 with cable bolt 16 secured within each borehole 14 by appropriately cured resin 18. Resin dams 20 and attachment member 22 are provided on each cable bolt 16 in the same manner as cable truss systems 10 and 50 described above. The cable truss system 70 differs from the cable truss systems 10 and 50 described above in that a splice tube 24 is utilized to secure the cable bolts 16 directly to each other with the attachment members 22 abutting opposite ends 26 of the splice tube 24. The roof support plates 34 including load-bearing surfaces 36, raised support members 38 and clamping fingers 40 will be attached directly to the respective cable bolts 16 rather than to an intermediate roof support cable 30.

The installation of the cable bolt 16 in the cable truss system 70 will preferably utilize the wrench disclosed in U.S. patent application Ser. No. 08/360,261 since the cable truss system 70 may not be easily adapted for pre-assembly of the splice tube 24 on the cable bolt 16. Additionally, the cable bolt plates 52 may be utilized with the cable truss system 70 to minimize the stress of the cable bolt 16 adjacent the borehole 14.

Figure 14:
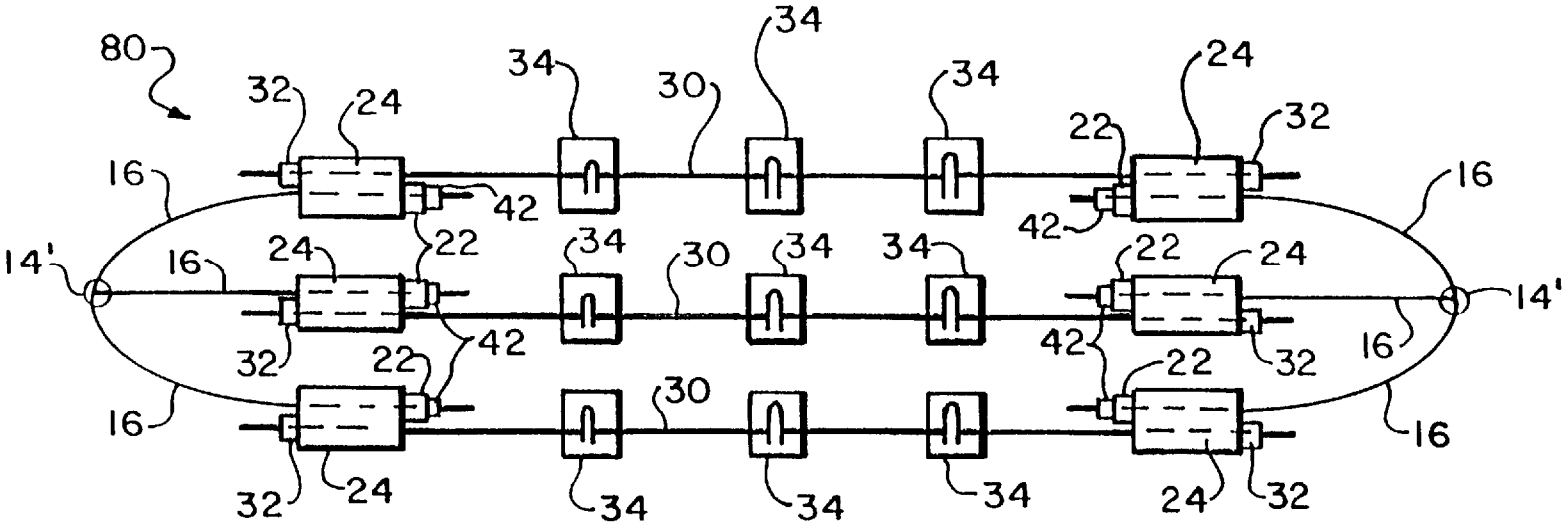
FIG. 14 is a schematic plan view illustrating a cable truss system according to a third embodiment of the present invention.

FIG. 14 is a plan view, looking up at the mine roof, of a cable truss system 80 according to a third embodiment of the present invention. The cable truss system 80 is substantially similar to the cable truss system 10 except that the spaced boreholes 14' include a plurality of cable bolts 16 secured therein by resin (not shown). Each cable bolt 16 includes an attachment member 22 abutting an end 26 of a splice tube 24 to secure the respective cable bolt 16 to a roof support cable 30 extending between the boreholes 14'. Each roof support cable 30 interconnects a pair of cable bolts 16 from respective boreholes 14'. Each roof support cable 30 includes a pair of support cable attachment members 32 engaging opposite ends 26 of respective splice tubes 24 from the attachment members 22 of the corresponding cable bolt 16. The installation of multiple cable bolts 16 in a single borehole 14' is known in the art and is shown in U.S. Pat. Nos. 5,417,521 and 5,462,391 which are incorporated herein by reference. Multiple cable truss systems such as disclosed in cable truss system 80 allow for increased strength in the resulting supporting system. Additionally, by providing individual splice tubes 24, the separate cables of the cable truss system 80 can be independently tensioned. Furthermore, these independent connections allow each borehole 14' to be interlaced with other boreholes 14' than the one immediately across the mine passageway therefrom. Such an interlaced construction is illustrated in U.S. Pat. No. 5,462,391.

Figure 15:
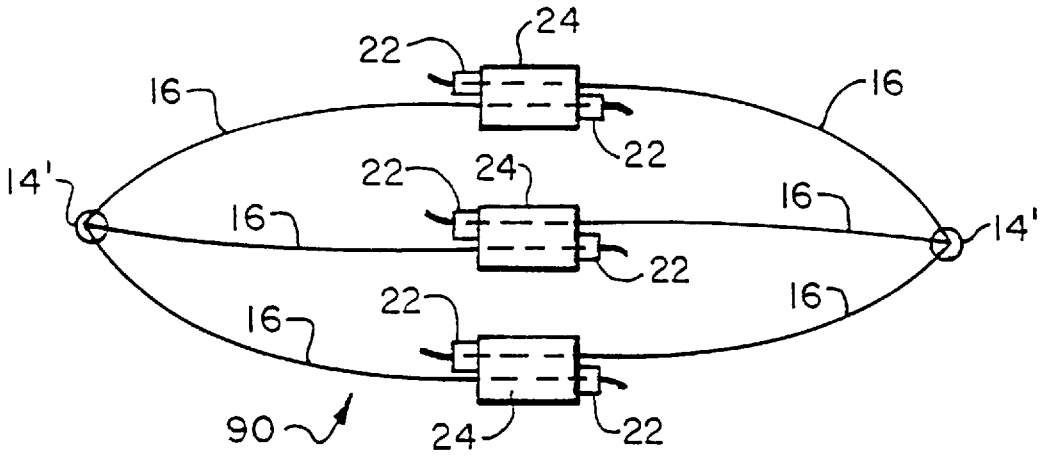
FIG. 15 is a schematic plan view illustrating a cable truss system according to a fourth embodiment of the present invention.

FIG. 15 is a plan view of a cable truss system 90 according to a fourth embodiment of the present invention. The cable truss system 90 is similar to the cable truss system 80 in that multiple cable bolts 16 are provided in each borehole 14'. The cable truss system 90 is also similar to the cable truss system 70 in that each cable bolt 16 is attached by a splice tube 24 to an opposed cable bolt from a spaced borehole 14'. The cable truss system 90 includes the same benefits of the multiple cable truss system 80 discussed in connection with FIG. 14 and further allows for the elimination of the separate roof support cables 30 similar to the cable truss system 70.

Figure 16:
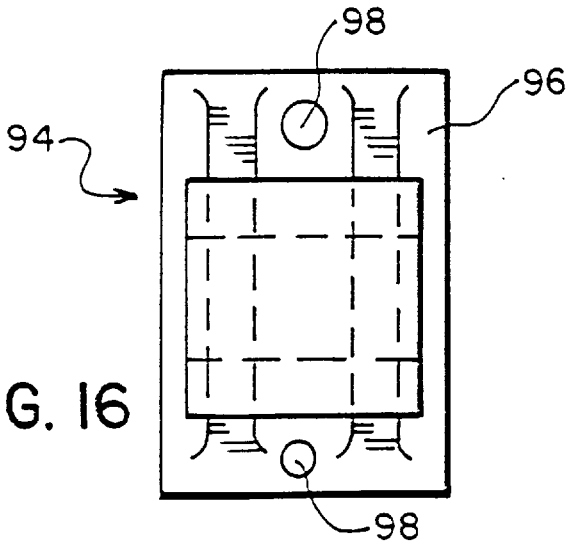
FIG. 16 is a perspective view of a modified splice tube for use with the cable truss systems illustrated in FIGS. 1, 8, 13, 14 and 15.
Figure 17:
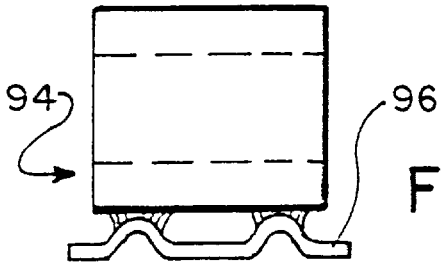
FIG. 17 is a plan view of the splice tube illustrated in FIG. 16.

FIGS. 16 and 17 illustrate a modified splice tube 94 which includes a bearing plate 96 adapted to abut against and help support the roof strata 12. The bearing plate 96 may further include one or more bolt holes 98 extending therethrough. Each bolt hole 98 is adapted to receive a roof cable bolt therethrough at a position between the boreholes 14. The modified splice tube 94 allows any of the cable truss systems according to the present invention to further include additional supporting cable bolts between the spaced boreholes 14.

Figure 18:
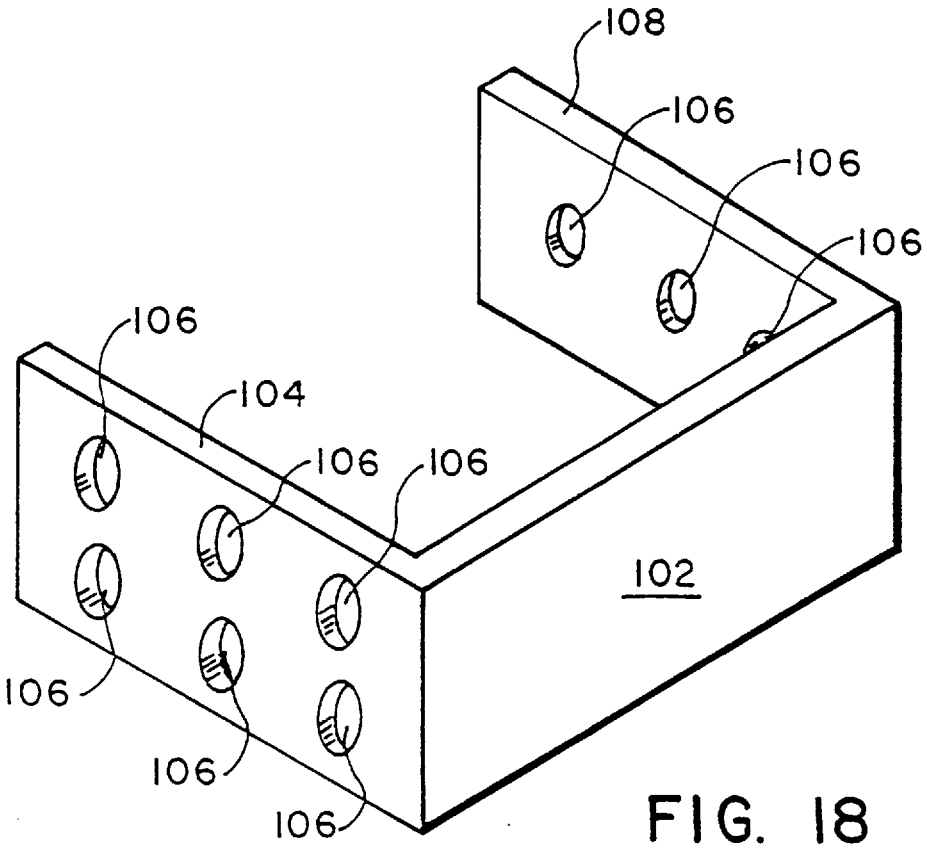
FIG. 18 is a perspective view of a multiple splice plate for use in a modified version of the cable truss system illustrated in FIGS. 14 and 15.
Figure 19:
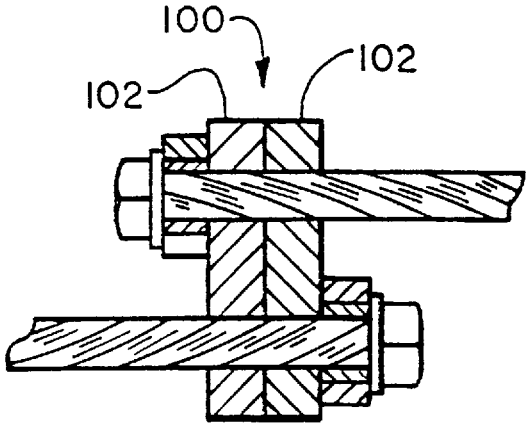
FIG. 19 is a sectional view of the multiple splice plate illustrated in FIG. 18.

FIGS. 18 and 19 illustrate a multiple splice plate configuration to replace the splice tubes 24 or 94 in the multiple cable truss systems 80 or 90 illustrated in FIGS. 14 and 15. The multiple splice plate 100 includes a pair of interlocking C-shaped channels 102, only one of which is shown in FIG. 18. A first end 104 of each C-shaped channel 102 includes two columns of cable-receiving holes 106 along the length of the first end with the cable-receiving holes 106 positioned in aligned pairs. The number of pairs of aligned cable-receiving holes 106 corresponds to the number of cables of the multiple cable truss system. The second end 108 of each C-shaped channel includes a single row of cable-receiving holes 106 therein. FIG. 19 illustrates the use of the multiple splice plate 100 in place of a plurality of splice tubes 24 or 94. The advantage of the multiple splice plate 100 is that it replaces a multitude of splice tubes. A disadvantage of the multiple splice plate 100 is that the multiple cables can no longer be independently tensioned since they are all tied together by the multiple splice plate 100.

Figure 20:
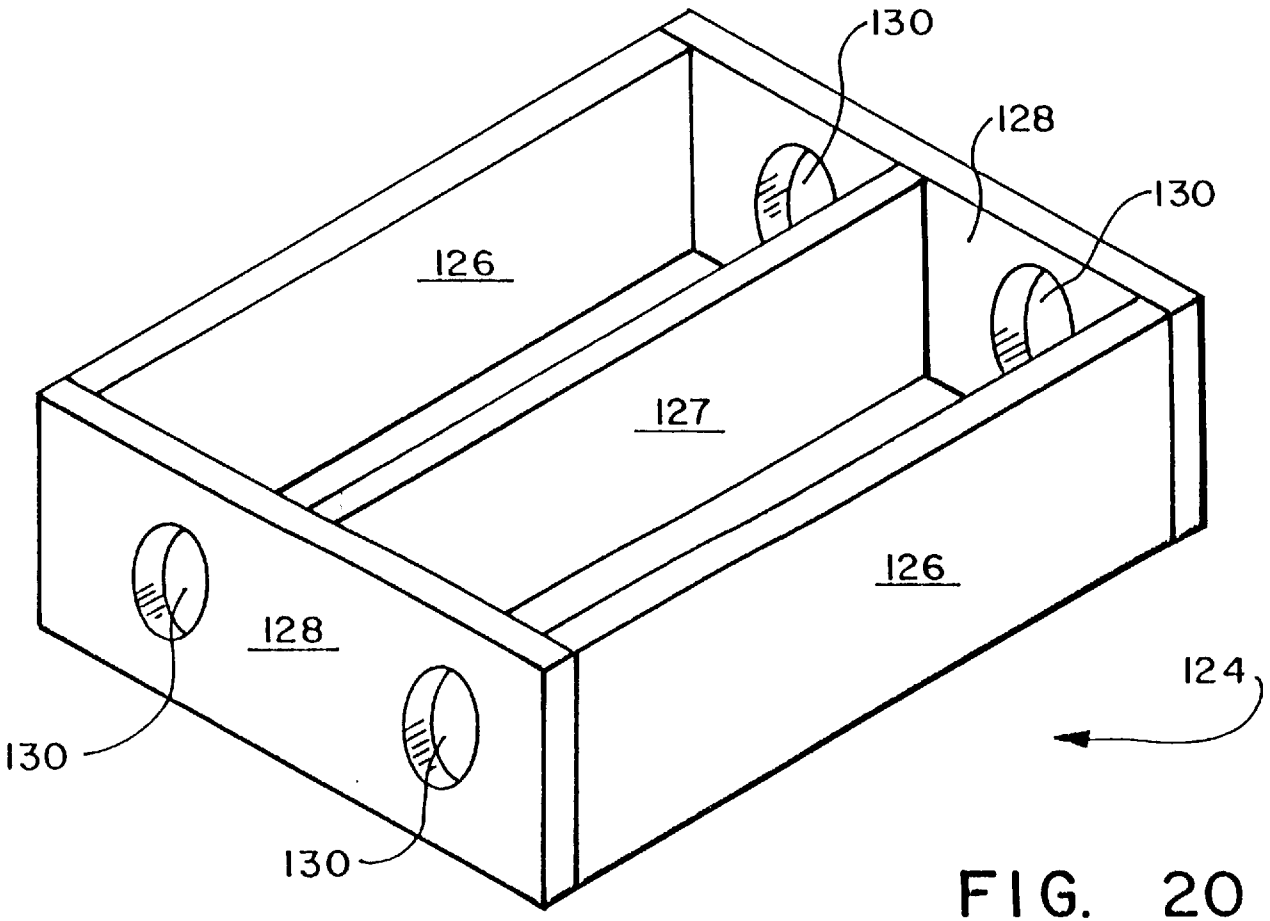
FIG. 20 is a perspective view of a modified splice tube for use with the cable truss systems illustrated in FIGS. 1, 8, 13, 14 and 15.

FIG. 20 is a perspective view of a further splice tube 124 which includes sides 126 extending between end members 128. Each end 128 will include a pair of cable-receiving holes 130 therein for receiving the appropriate cables therethrough. The splice tube 124 may additionally include a center web 127 extending between the ends 128. The sides 126 and center web 127 essentially form the conduit of the splice tube 24 described above such that he splice tube 124 operates substantially the same as the splice tube 24 discussed above. Splice tube 124 is merely intended to illustrate the wide variety of modifications which may be made to the splice tubes of the present invention. Splice tube 124 has the disadvantage of being more difficult to manufacture than the tube configuration of splice tube 24 discussed above.

It will be apparent to those of ordinary skill in the art that modifications may be made to the present invention without departing from the spirit and scope thereof. Consequently, the scope of the present invention is intended to be defined by the attached claims.

What is claimed is:

1. A cable mine roof supporting system comprising:

at least two boreholes spaced from each other;

at least one cable roof bolt secured in each said borehole, with a leading end of each said cable bolt secured within one said borehole and a trailing end extending out from said borehole;

at least one splice tube coupled to said trailing end of each said cable bolt, each said splice tube comprising an elongated conduit between a pair of spaced ends, said conduit adapted to receive at least a pair of cables therethrough;

a cable attachment on said trailing end of the said cable roof bolt at a position where said splice tube is positioned on said cable roof bolt between said cable attachment and said borehole, wherein said cable attachment has a diameter larger than the inner dimensions of said conduit of said splice tube and said cable attachment is adapted to abut against one end of said conduit of said splice tube, and wherein each said splice tube connects two of said cable bolts extending from two of said spaced boreholes; and a plurality of roof support plates held against a mine roof by said cable bolts between said spaced boreholes, each said roof plate including:

a load-bearing surface positioned adjacent the mine roof, a raised support member extending from said load-bearing surface, and a cable engaging member extending from said support member and adapted to secure said roof plate to one said cable bolt.

2. A cable mine roof supporting system comprising:

at least two boreholes spaced from each other;

at least one cable roof bolt secured in each said borehole, with a leading end of each said cable bolt secured within one said borehole and a trailing end extending out from said borehole;

at least one splice tube coupled to said trailing end of each said cable bolt, each said splice tube comprising an elongated conduit between a pair of spaced ends, said conduit adapted to receive at least a pair of cables therethrough;

a cable attachment on said trailing end of the said cable roof bolt at a position where said splice tube is positioned on said cable roof bolt between said cable attachment and said borehole, wherein said cable attachment has a diameter larger than the inner dimensions of said conduit of said splice tube and said cable attachment is adapted to abut against one end of said conduit of said splice tube, at least one roof support cable extending between two of said spaced boreholes, said support cable attached to one said cable roof bolt by one said splice tube at a first end of said support cable and attached to another said cable roof bolt by another said splice tube at another said cable support cable; and a plurality of roof support plates held against a mine roof by said roof support cable between said spaced boreholes, each said roof plate including:

a load-bearing surface positioned adjacent the mine roof, a raised support member extending from said load-bearing surface, and a cable engaging member extending from said support member and adapted to secure said roof plate to a cable.

3. The cable mine roof supporting system comprising:

a pair of spaced-apart boreholes;

a plurality of multi-strand cable mine roof bolts in each said borehole, with a leading end of each said cable bolt secured within said borehole and a trailing end extending out from said borehole; and connecting means for connecting each said multi-strand connecting bolts secured in one of said pair of boreholes with one of said plurality of multi-strand cable bolts which is secured in the other of said pair of boreholes, wherein said connecting means includes at least one roof support cable extending between said pair of spaced boreholes, said support cable attached to at least one said multi-strand cable bolt which is secured in one of said pair of boreholes by a first connector at a first end of said support cable and said support cable is attached to at least one said multi-strand cable bolt which is secured in the other of said pair of boreholes by a second connector at a second end of said support cable; and a plurality of roof support plates held against a mine roof by said roof support cable between said spaced boreholes, each said roof plate including:

a load-bearing surface positioned adjacent the mine roof, a raised support member extending from said load-bearing surface, and a cable engaging member extending from said support member and adapted to secure said roof plate to a cable.

* * * * *

Disclaimer 5,836,720 — John C. Stankus, Canonsburg; John G. Oldsen, Butler, both of PA; Brian R. Castle, Rolla, MO. MINE ROOF SUPPORT SYSTEM. Patent dated November 17, 1998. Disclaimer filed January 24, 2000, by the assignee, Jenmar Corp.

Hereby enters this disclaimer to claims 2 of said patent.

*(Official Gazette,* April 18, 2000)